US007412916B2

(12) United States Patent
Lloyd

(10) Patent No.: US 7,412,916 B2
(45) Date of Patent: Aug. 19, 2008

(54) FIXED DEPLOYED NET FOR HIT-TO-KILL VEHICLE

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/334,102

(22) Filed: Jan. 18, 2006

(65) Prior Publication Data

US 2006/0112817 A1 Jun. 1, 2006

Related U.S. Application Data

(62) Division of application No. 10/384,804, filed on Mar. 10, 2003.

(60) Provisional application No. 60/406,828, filed on Aug. 29, 2002.

(51) Int. Cl.
*B64D 1/02* (2006.01)
*F42B 12/66* (2006.01)
*F42B 12/02* (2006.01)

(52) U.S. Cl. ..... 89/1.11; 89/1.34; 102/473; 102/504

(58) Field of Classification Search ..... 102/477, 102/351, 357, 402, 405, 504, 473, 501, 517, 102/293, 474; 89/1.11, 1.1, 1.34; 244/3, 244/110 C See application file for complete search history.

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,244,046 | A | 10/1917 | Ffrench |
| 1,300,333 | A | 4/1919 | Berry |
| 1,305,967 | A | 6/1919 | Hawks |
| 2,296,980 | A | 9/1942 | Carmichael |
| 2,308,683 | A | 1/1943 | Forbes |
| 2,322,624 | A | 6/1943 | Forbes |
| 2,337,765 | A | 12/1943 | Nahirney |
| 2,925,965 | A | 2/1960 | Pierce |
| 2,988,994 | A | 6/1961 | Fleischer, Jr. et al. |
| 3,332,348 | A | 7/1967 | Myers et al. |
| 3,565,009 | A | 2/1971 | Allred et al. |

(Continued)

FOREIGN PATENT DOCUMENTS

| | | |
|---|---|---|
| DE | 22 06 403 | 8/1973 |

(Continued)

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapther 3, pp. 99-197.

(Continued)

*Primary Examiner*—James S Bergin
(74) *Attorney, Agent, or Firm*—Iandiorio Teska & Coleman

(57) ABSTRACT

A method of destroying a target includes positioning a hit-to-kill vehicle in the trajectory path of a target, and deploying a net including a plurality of rods held in a spaced relationship by the net for destroying the target in case the hit-to-kill vehicle misses the target.

4 Claims, 7 Drawing Sheets

U.S. PATENT DOCUMENTS

| | | | |
|---|---|---|---|
| 3,656,433 | A | 4/1972 | Trailkill et al. |
| 3,665,009 | A | 5/1972 | Dickinson, Jr. |
| 3,757,694 | A | 9/1973 | Talley et al. |
| 3,771,455 | A | 11/1973 | Haas |
| 3,796,159 | A | 3/1974 | Conger |
| 3,797,359 | A | 3/1974 | Mawhinney et al. |
| 3,818,833 | A | 6/1974 | Throner, Jr. |
| 3,846,878 | A | 11/1974 | Monson et al. |
| 3,851,590 | A | 12/1974 | LaCosta |
| 3,861,314 | A | 1/1975 | Barr |
| 3,877,376 | A | 4/1975 | Kupelian |
| 3,902,424 | A | 9/1975 | Dietsch et al. |
| 3,903,804 | A | 9/1975 | Luttrell et al. |
| 3,915,092 | A | 10/1975 | Monson et al. |
| 3,941,059 | A | 3/1976 | Cobb |
| 3,949,674 | A | 4/1976 | Talley |
| 3,954,060 | A | 5/1976 | Haag et al. |
| 3,977,330 | A | 8/1976 | Held |
| 4,026,213 | A | 5/1977 | Kempton |
| 4,036,140 | A | 7/1977 | Korr et al. |
| 4,089,267 | A | 5/1978 | Mescall et al. |
| 4,106,410 | A | 8/1978 | Borcher et al. |
| 4,147,108 | A | 4/1979 | Gore et al. |
| 4,172,407 | A | 10/1979 | Wentink |
| 4,210,082 | A | 7/1980 | Brothers |
| 4,211,169 | A | 7/1980 | Brothers |
| 4,231,293 | A | 11/1980 | Dahn et al. |
| 4,289,073 | A | 9/1981 | Romer et al. |
| 4,376,901 | A | 3/1983 | Pettibone et al. |
| 4,430,941 | A | 2/1984 | Raech, Jr. et al. |
| 4,455,943 | A | 6/1984 | Pinson |
| 4,516,501 | A | 5/1985 | Held et al. |
| 4,538,519 | A | 9/1985 | Witt et al. |
| 4,638,737 | A | 1/1987 | McIngvale |
| 4,655,139 | A | 4/1987 | Wilhelm |
| 4,658,727 | A | 4/1987 | Wilhelm et al. |
| 4,676,167 | A | 6/1987 | Huber, Jr. et al. |
| 4,745,864 | A | 5/1988 | Craddock |
| 4,770,101 | A | 9/1988 | Robertson et al. |
| 4,777,882 | A | 10/1988 | Dieval |
| 4,848,239 | A | 7/1989 | Wilhelm |
| 4,922,826 | A | 5/1990 | Busch et al. |
| 4,957,046 | A | 9/1990 | Puttock |
| 4,995,573 | A | 2/1991 | Wallow |
| 4,996,923 | A | 3/1991 | Theising |
| H1047 | H | 5/1992 | Henderson et al. |
| H1048 | H | 5/1992 | Wilson et al. |
| 5,182,418 | A | 1/1993 | Talley |
| 5,223,667 | A | 6/1993 | Anderson |
| 5,229,542 | A | 7/1993 | Bryan et al. |
| 5,313,890 | A | 5/1994 | Cuadros |
| 5,370,053 | A | 12/1994 | Williams et al. |
| 5,524,524 | A | 6/1996 | Richards et al. |
| 5,535,679 | A | 7/1996 | Craddock |
| 5,542,354 | A | 8/1996 | Sigler |
| 5,544,589 | A | 8/1996 | Held |
| 5,577,431 | A | 11/1996 | Küsters |
| 5,578,783 | A | 11/1996 | Brandeis |
| 5,583,311 | A | 12/1996 | Rieger et al. |
| 5,622,335 | A | 4/1997 | Trouillot et al. |
| D380,784 | S | 7/1997 | Smith |
| 5,670,735 | A | 9/1997 | Ortmann et al. |
| 5,691,502 | A | 11/1997 | Craddock et al. |
| 5,796,031 | A | 8/1998 | Sigler |
| 5,823,469 | A | 10/1998 | Arkhangelsky et al. |
| 5,929,370 | A | 7/1999 | Brown et al. |
| 5,936,191 | A | 8/1999 | Bisping et al. |
| 6,035,501 | A | 3/2000 | Bisping et al. |
| 6,044,765 | A | 4/2000 | Regebro |
| 6,116,544 | A * | 9/2000 | Forward et al. ..... 244/158.2 |
| 6,173,922 | B1 * | 1/2001 | Hoyt et al. ..... 244/158.2 |
| 6,186,070 | B1 | 2/2001 | Fong et al. |
| 6,276,277 | B1 | 8/2001 | Schmacker |
| 6,279,478 | B1 | 8/2001 | Ringer et al. |
| 6,279,482 | B1 | 8/2001 | Smith et al. |
| 6,598,534 | B2 | 7/2003 | Lloyd et al. |
| 6,622,632 | B1 | 9/2003 | Spivak |
| 6,666,145 | B1 | 12/2003 | Nardone et al. |
| 6,779,462 | B2 | 8/2004 | Lloyd |
| 6,910,423 | B2 | 6/2005 | Lloyd |
| 6,920,827 | B2 | 7/2005 | Llyod |
| 6,931,994 | B2 | 8/2005 | Lloyd |
| 6,973,878 | B2 | 12/2005 | Lloyd et al. |
| 2003/0019386 | A1 | 1/2003 | Lloyd et al. |
| 2004/0011238 | A1 | 1/2004 | Ronn et al. |
| 2004/0055498 | A1 | 3/2004 | Lloyd |
| 2004/0129162 | A1 | 7/2004 | Lloyd |
| 2005/0016372 | A1 | 1/2005 | Kilvert |
| 2005/0109234 | A1 | 5/2005 | Lloyd |

FOREIGN PATENT DOCUMENTS

| | | | |
|---|---|---|---|
| DE | 3327043 | A1 | 2/1985 |
| DE | 3722420 | A1 | 1/1989 |
| DE | 37 35 426 | | 5/1989 |
| DE | 3735426 | A1 | 5/1989 |
| DE | 3830527 | A1 | 3/1990 |
| DE | 3834367 | A1 | 4/1990 |
| DE | 3934042 | A1 | 4/1991 |
| DE | 4437412 | | 9/1995 |
| EP | 270 401 | A1 | 6/1988 |
| EP | 0 655 603 | | 5/1995 |
| EP | 872705 | A2 | 10/1998 |
| EP | 902250 | A2 | 3/1999 |
| FR | 2678723 | A1 | 1/1993 |
| FR | 2695467 | A1 | 3/1994 |
| GB | 550001 | | 12/1942 |
| GB | 2236581 | | 4/1991 |
| JP | 1-296100 | | 11/1989 |
| WO | WO 97/27447 | | 7/1997 |
| WO | WO 99/30966 | | 6/1999 |

OTHER PUBLICATIONS

Richard M. Lloyd, "Physics of Direct Hit and Near Miss Warhead Technology", vol. 194, Progress in Astronautics and Aeronautics, Copyright 2001 by the American Instituted of Aeronautics and Astronautics, Inc., Chpater 6, pp. 311-406.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.

Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.

FAS Military Analysis Network (http://www.fas.org/man/dod-101/sys/land/m546.htm): M546 APERS-T 105-mm, Jan. 21, 1999.

FAS Military Analysis Network (http://www.fas.org/man/dod-101/sys/land/bullets2.htm): Big Bullets for Beginners, Feb. 6, 2000.

"Report of the American Physical Society Study Group on Boost-Phase Intercept Systems for National Missile Defense", Scientific and Technical Issues, Jul. 2003, pp. 241-248, http://www.aps.org/public_affairs/popa/reports/nmdfull-report.pdf.

U.S. Appl. No. 10/301,420, filed Nov. 21, 2002, Lloyd.

U.S. Appl. No. 10/685,242, filed Oct. 14, 2003, Lloyd.

U.S. Appl. No. 10/924,104, filed Aug. 23, 2004, Lloyd.

U.S. Appl. No. 10/960,842, filed Oct. 7, 2004, Lloyd.

English translation of DT 2206403 A, Held, Manfred, Germany Aug. 1973.

* cited by examiner

FIXED DEPLOYED NET FOR HIT-TO-KILL VEHICLE

RELATED APPLICATIONS AND PRIORITY CLAIM

This application is a divisional application of prior U.S. patent application Ser. No. 10/384,804 filed on Mar. 10, 2003, which claims the benefit of and priority to U.S. Provisional Application Ser. No. 60/406,828 filed Aug. 29, 2002, each of which are incorporated into this application by reference.

FIELD OF THE INVENTION

This invention relates to improvements in hit-to-kill vehicles.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads. Blast fragmentation and kinetic energy rod warheads are kill enhancement devices that are carried along on the "hit-to-kill" vehicle.

"Hit-to-kill" vehicles are typically launched into a position proximate a re-entry vehicle or other target via a missile such as the NMD System, THAAD, SM3, Trident or MX missile. The kill vehicle is navigable and designed to directly strike the re-entry vehicle to render it inoperable. Countermeasures, however, can be used to avoid the "hit-to-kill" vehicle. Moreover, nuclear or biological warfare bomblets and chemical warfare submunition payloads are carried by some targets threats. If the nuclear payload or more then one of these bomblets or chemical submunition payloads can survive, they would cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the nuclear target and, again, fall out, radiation, biological bomblets and/or chemical submunition payloads survive and cause heavy casualties. Also, a blast fragmentation warhead requires a fuse detection device that must be very accurate. Those types of accuracies in outer space are very difficult to achieve. Other warheads concepts need to be developed.

The textbooks by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, and "Physics of Direct Hit and Near Miss Warhead Technology", Volume 194, ISBN 1-56347-473-5, incorporated herein by this reference, provide additional details concerning "hit-to-kill" vehicles and blast fragmentation type warheads. Chapter 5 and Chapter 3 of these textbooks propose a kinetic energy rod warhead.

The primary components associated with theoretical kinetic energy rod warhead include a hull, a projectile core or bay in the hull including a number of individual lengthy cylindrical rods or projectiles, and an explosive charge in the hull about the projectile bay. When the explosive charge is detonated, the projectiles are deployed.

Two primary advantages of a kinetic energy rod warhead is that 1) it does not rely on precise navigation as is the case with "hit-to-kill" vehicles and 2) it provides better penetration than blast fragmentation type warheads. To date, however, kinetic energy rod warheads have not been widely accepted nor have they yet been fully deployed. Also, this concept requires a fuse to determine when to deploy the rods. Even though it does not need to be as accurate as the blast fragmentation warhead, it still must be incorporated into the vehicle.

Thus, those skilled in the art have endeavored to modify warheads such as the hit-to-kill vehicle to increase its lethality. Lockheed, for example, proposed a deployable fabric which surrounds the hit-to-kill vehicle and designed to impact a target in the case where the hit-to-kill vehicle does not directly strike and destroy the target. These concepts were only designed for a very small miss distance. Advanced countermeasure threats would defeat such a concept. And, with this design, it is possible for submunitions to escape destruction and thus the deployable fabric design did not gain wide acceptance. Also, the fabric does not penetrate thick payloads when compared to high density rods. The fabric concept is only required to slap the target with an impulse cause a delayed kill. Those types of kills are not accepted today and more lethal concepts are required.

SUMMARY OF THE INVENTION

It is therefore an object of this invention to provide a hit-to-kill vehicle which is able to destroy a nuclear target and/or its submunitions even if the main body of the hit-to-kill misses the target and/or fails to destroy a submunition.

It is a further object of this invention to provide such a hit-to-kill vehicle which exhibits the benefits and the advantages of both hit-to-kill vehicles and kinetic energy rods when engaging a complex counter threat.

This invention results from the realization that a higher lethality hit-to-kill vehicle is effected by the addition of a deployable net which positions a number of spaced kinetic energy rod warhead rods or projectiles in an array in space about the main body of the hit-to-kill vehicle to destroy nuclear targets and/or their submunitions even if the main body of the hit-to-kill vehicle does not. This concept does not require a fuse because the rods are held (fixed) in place. The spray pattern density is constant and fusing errors are not even considered. Since this concept is used in outer space, there no air drag on the deployed net. The net travels along with the kill vehicle killing the target given an off hit engagement.

This invention features a warhead comprising a hit-to-kill vehicle and a hub about the hit-to-kill vehicle including packaged therein a net, means for deploying the net, and a plurality of rods attached to the net for destroying a target when the net is deployed in the vicinity path of the target in case the hit-to-kill vehicle misses the target.

In one embodiment, the means for deploying the net includes an inflatable superstructure with a plurality of inflatable vanes and a circumferential inflatable ring. In another embodiment, the means for deploying the net includes thrusters attached to the periphery of the net.

The net may be round and include vertical members intersecting horizontal members or circular members intersecting axially extending members. Typically, the net includes intersecting members and the rods are disposed at the intersection of the members.

One method of destroying a target in accordance with this invention includes positioning a hit-to-kill vehicle in the trajectory path of a target and deploying a net including a plurality of rods held in a spaced relationship by the net for destroying the target in case the hit-to-kill vehicle misses the target.

One method of manufacturing a warhead in accordance with this invention features packaging a net, means for deploying the net, and a plurality of rods attached to the net in a hub and attaching the hub to a hit-to-kill vehicle. A plurality of rods are secured at the interstices of a net, the net is packaged in a hub and the hub is coupled to a hit-to-kill vehicle.

In the deployed configuration, the warhead of this invention includes a hit-to-kill vehicle, a hub about the hit-to-kill vehicle, a net extending outward from the hub, and a plurality of rods attached to the net for destroying a target when the net is deployed in the vicinity path of the target in case the hit-to-kill vehicle misses the target.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
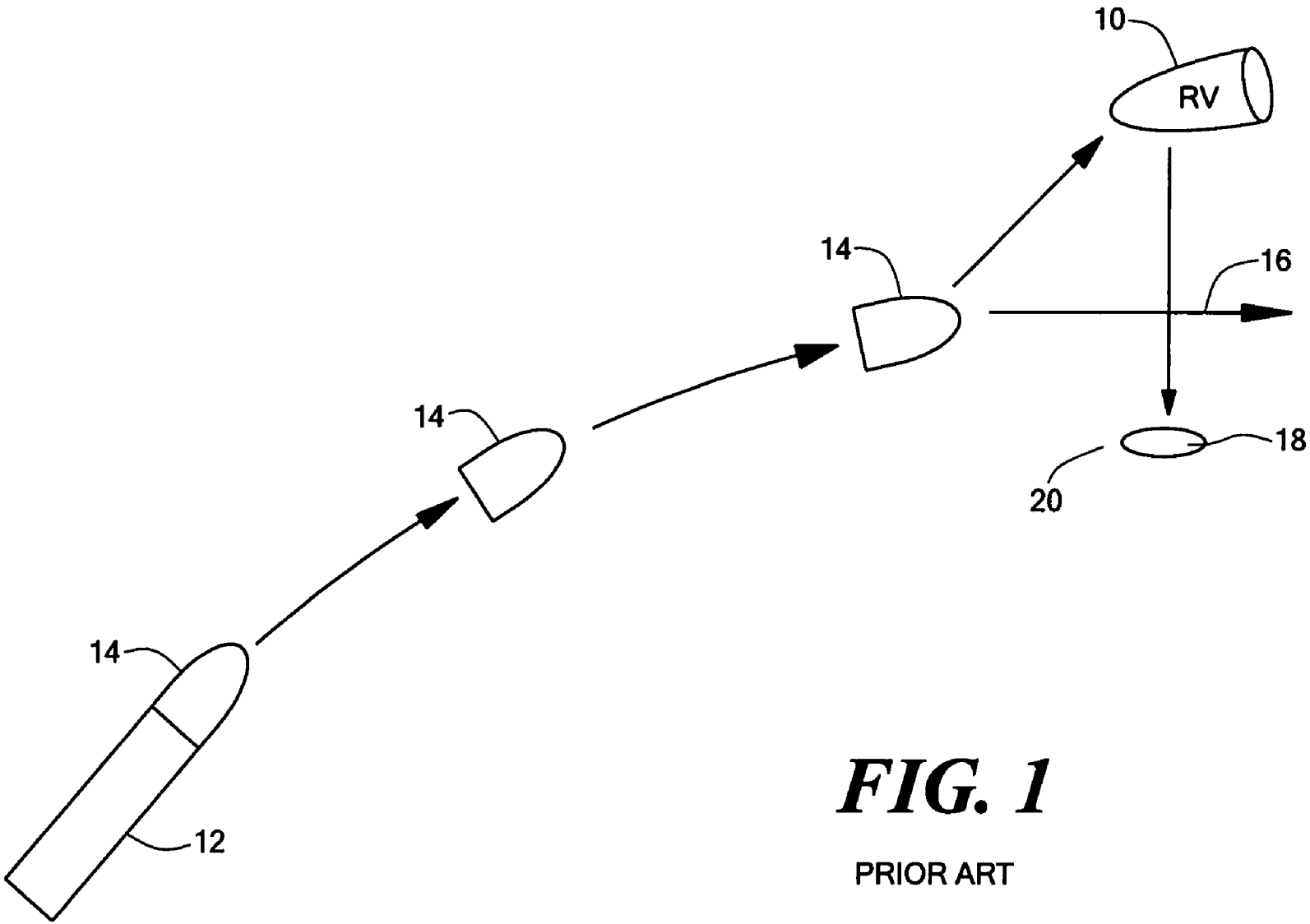
FIG. 1 PRIOR ART
FIG. 1 is a schematic view showing the deployment of a prior art hit-to-kill vehicle.
Figure 2:
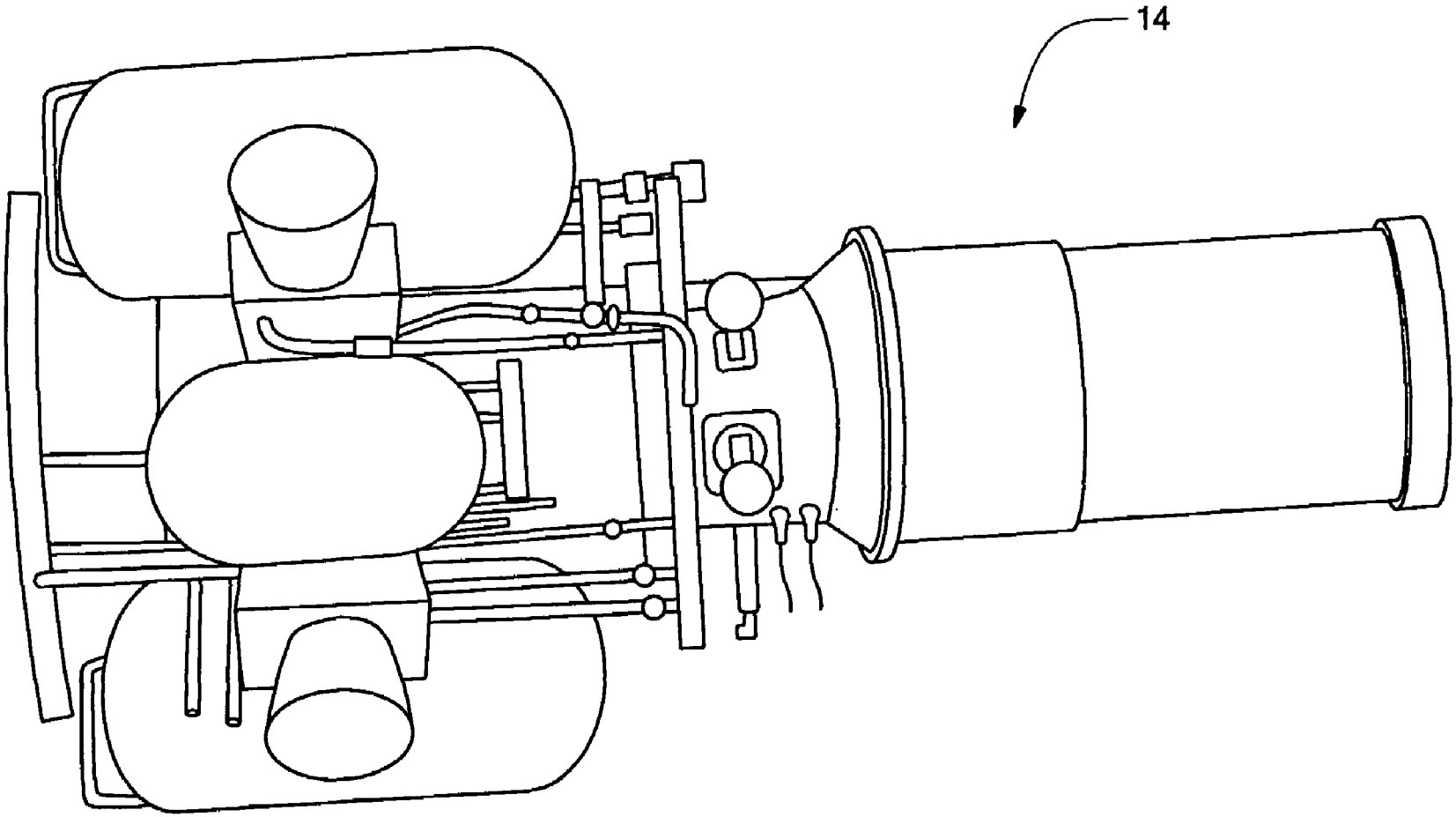
FIG. 2 PRIOR ART
FIG. 2 is a schematic three dimensional view of a prior art hit-to-kill vehicle.

As discussed in the background section above, hit-to-kill vehicles are typically launched into a position proximate re-entry vehicle 10, FIG. 1 or other target via missile 12. Hit-to-kill vehicle 14 is navigatable and designed to strike re-entry vehicle 10 to render it inoperable. Counter measures, however, can be used to avoid kill vehicle 14. Vector 16 shows kill vehicle 14 missing re-entry vehicle 10. Moreover, nuclear or biological bomblets and chemical submunition payloads 18 are carried by some threats and one or more of these bomblets or chemical submunition payloads 18 can survive, as shown at 20, and cause heavy casualties even if kill vehicle 14 does accurately strike target 10. FIG. 2 shows hit-to-kill vehicle 14 in more detail.

Figure 3:
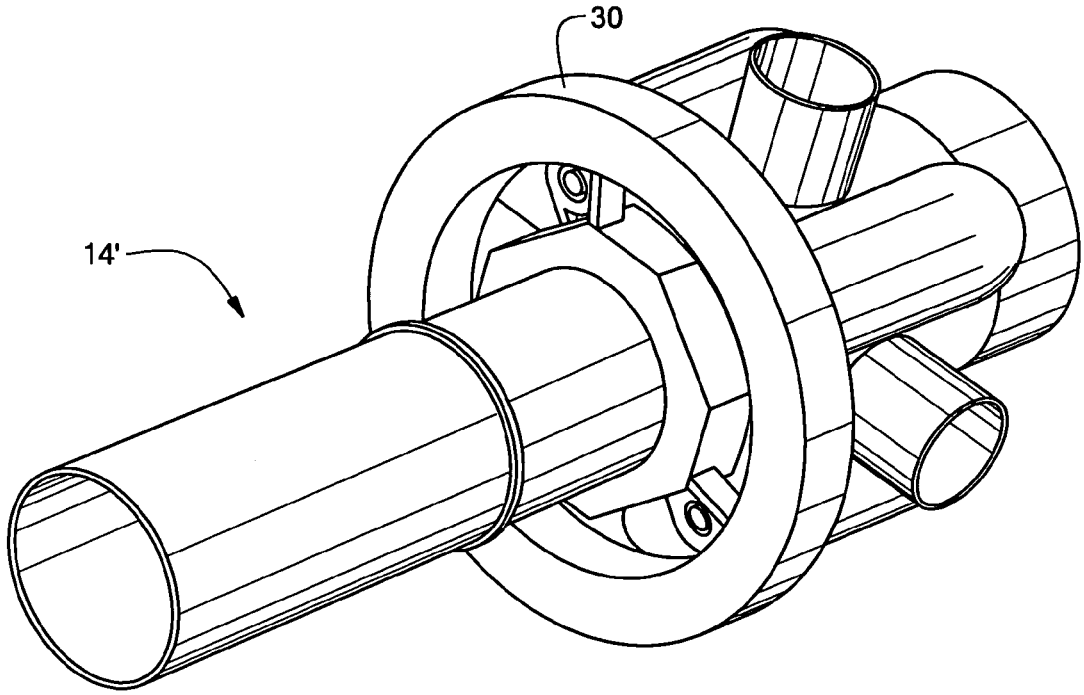
FIG. 3 is a schematic three dimensional view showing the modified hit-to-kill vehicle of the subject invention.

In this invention, hit-to-kill 14', FIG. 3 is modified to include hub 30 encircling vehicle 14. Hub 30 includes a net, means for deploying the net, and a plurality of kinetic energy rod warhead rods packaged therein preferably secured to the net at the interstices thereof.

Figure 4:
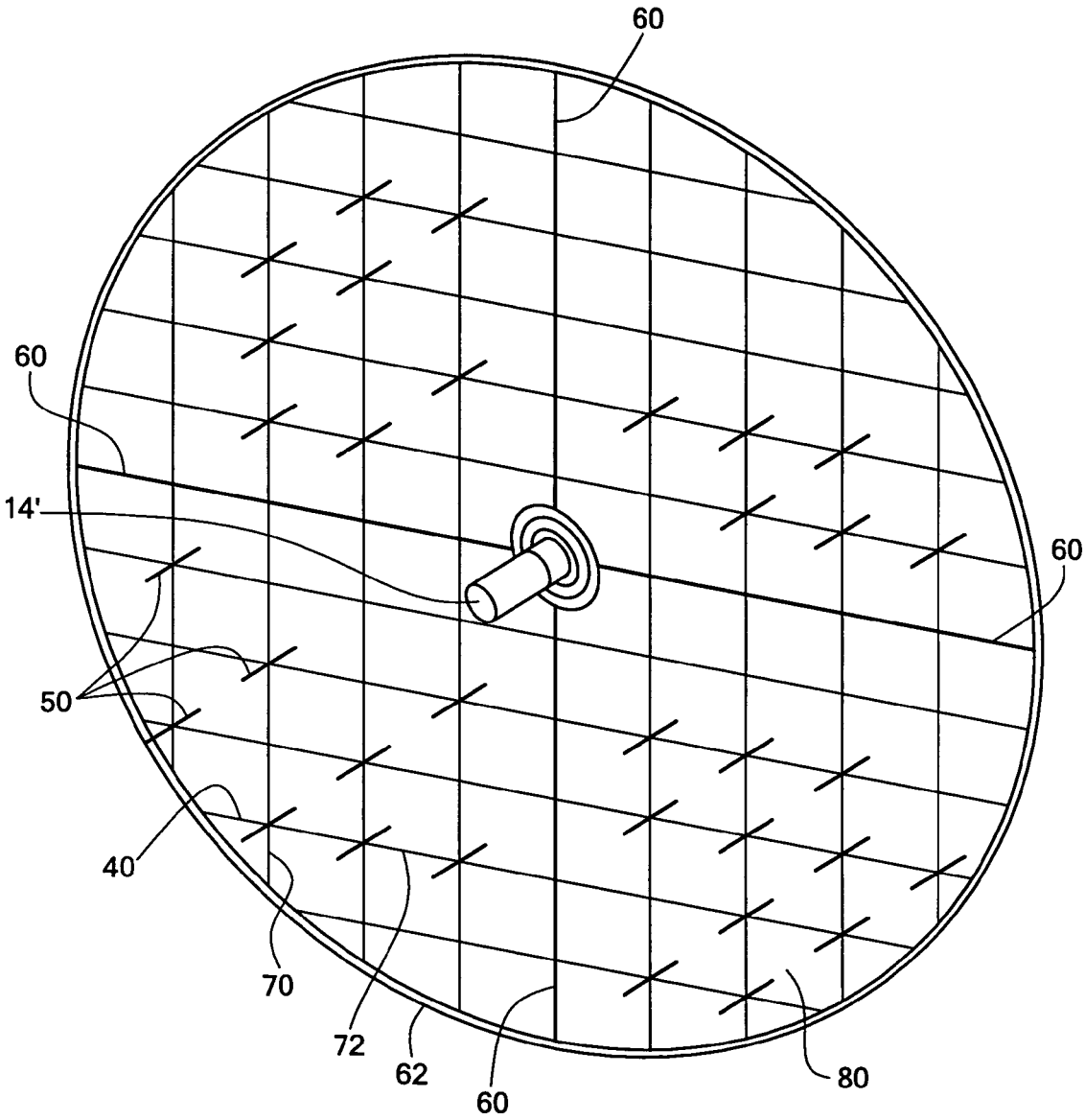
FIG. 4 is a schematic three dimensional view showing the deployment of the net of the subject invention about the hit-to-kill vehicle.

FIG. 4 shows net 40 deployed and rods 50 held in a spaced relationship by the net. In this embodiment, the means for deploying net 40 is an inflatable superstructure including inflatable vanes 60 and circumferential inflatable ring 62. In this example, 20 foot diameter net 40 is round and includes vertical nylon members 70 intersecting horizontal nylon members 72. Rods 50 are secured at the intersection of all or most of such members. The primary purpose of net 40 is to orient rods 50 in a spaced relationship in order to destroy a target or submunitions not destroyed by the main body of hit-to-kill vehicle 14'. In the example shown in FIG. 4, fabric layer 80 may also be used in connection with net 40. A gas generator connected to the inflatable superstructure inflates the vanes 60 and ring 62.

The advantage of this system over a kinetic energy rod warhead is that the density of the rods in space is held constant. In a kinetic energy rod warhead, in contrast, the density of the rods deployed as projectiles decreases rapidly after deployment. Those skilled in the art will know how to select the appropriate density for the rods by fabricating nets of different configurations.

Figure 5:
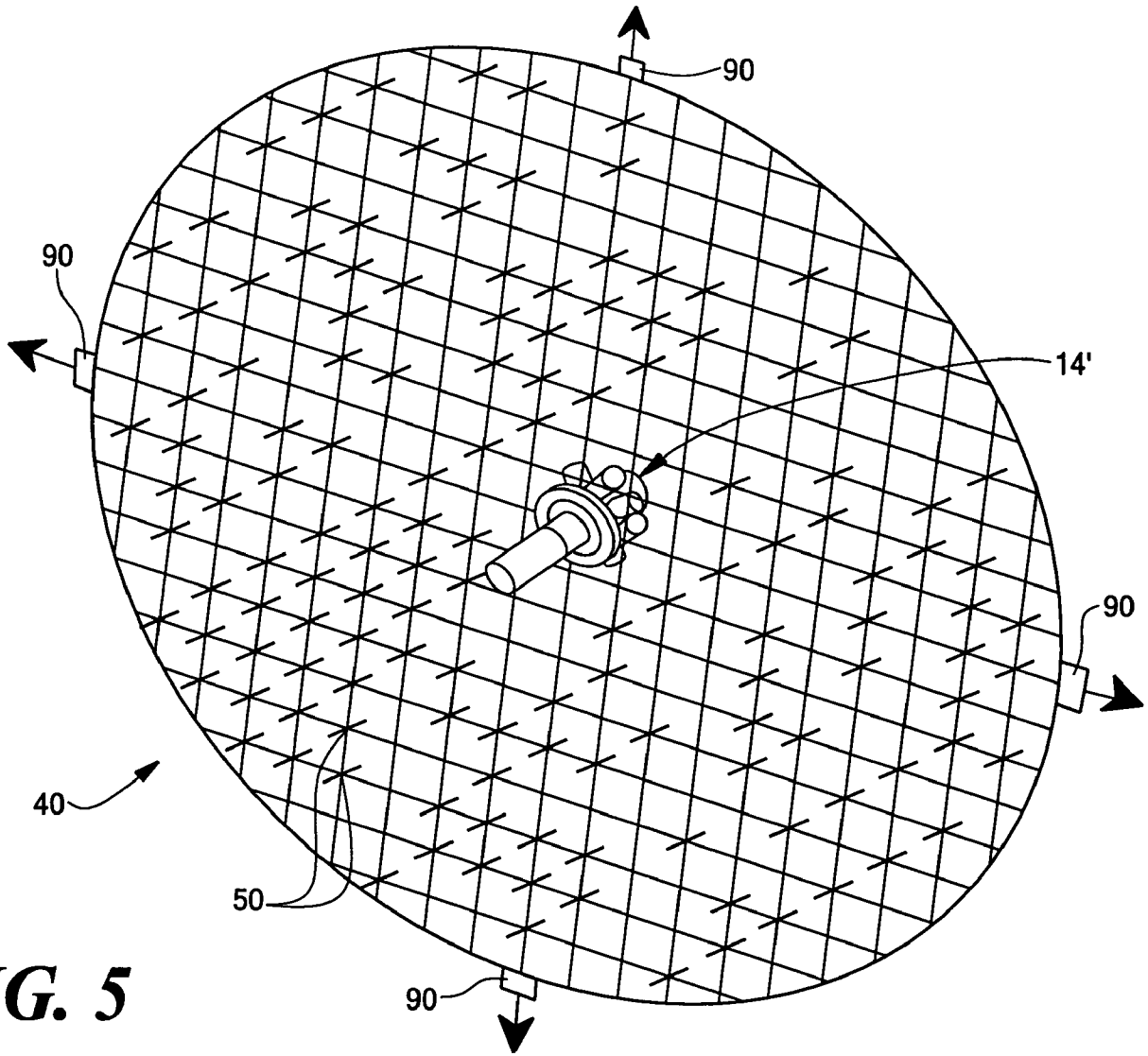
FIG. 5 is a schematic three dimensional view showing another embodiment of a deployable net in accordance with the subject invention.
Figure 6:
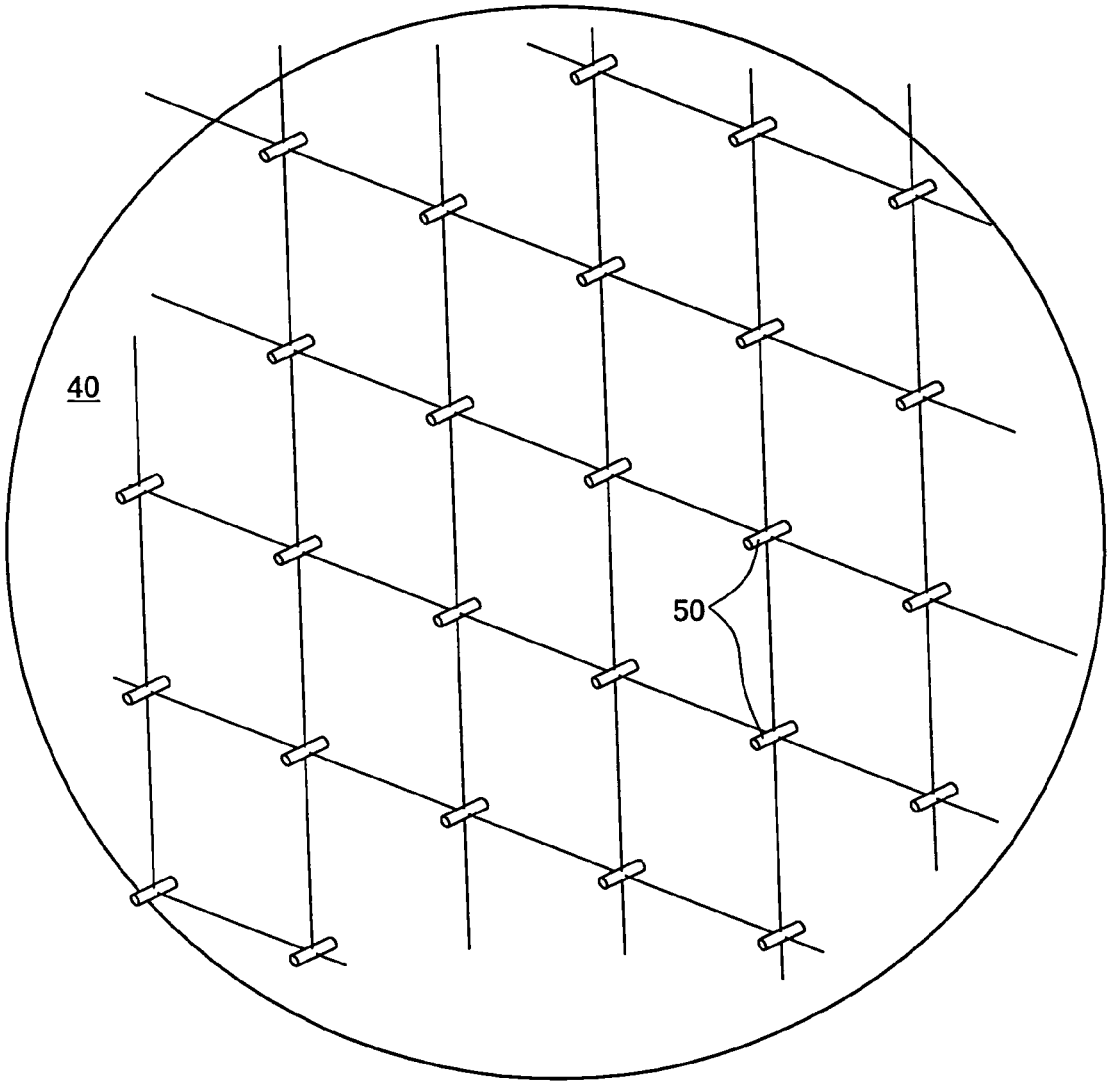
FIG. 6 is a schematic three dimensional view showing a portion of the net of FIG. 5.

In the embodiment of FIGS. 5-6, small thrusters 90, attached to the periphery of net 40 are the means for deploying net 40. Rods 50 may be made of titanium and cylindrical in shape although the other rod shapes disclosed in U.S. patent application Ser. No. 10/162,498, incorporated herein by this reference, may also be used.

Figure 7:
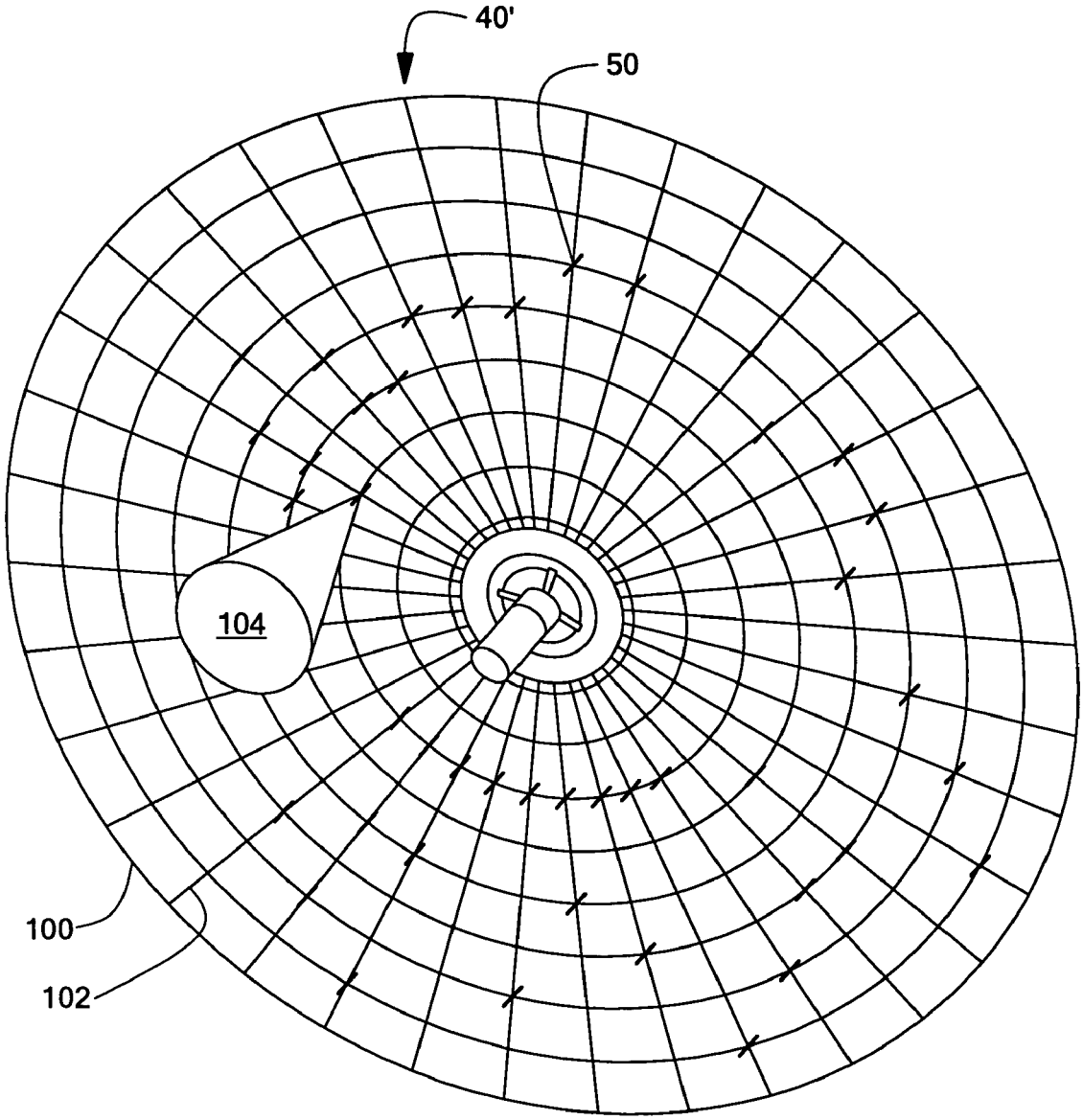
FIG. 7 is a schematic three dimensional view showing another design for a deployable net in accordance with the subject invention.

In FIG. 7, net 40' includes circular members 100 intersecting radially extending members 102. As shown, the main body of the hit-to-kill vehicle has missed target 104 but since the net is deployed in the vicinity of the target, rods or projectiles 50, held in a fixed spaced position in space, will destroy target 104.

The net may be deployed by thrusters as discussed above with reference to FIG. 5 or by the addition of an inflatable superstructure as discussed above with reference to FIG. 4, and/or a combination of both designs. Thus, the hit-to-kill vehicle of the subject invention has enhanced lethality due to the addition of the kinetic energy rods held in a fixed spaced relation by the net and is thus able to destroy a nuclear target and/or its submunitions even if the main body of the hit-to-kill vehicle misses the target and/or fails to destroy a submunition. The result is a system which exhibits the benefits and advantages of both hit-to-kill vehicles and kinetic energy rod warheads. Fusing is typically not required as is the case with the Lockheed fabric design.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A method of destroying a target comprising:

positioning a hit-to-kill vehicle in the trajectory path of a target; and deploying a net by an inflatable superstructure including a plurality of vanes and an inflatable ring, said inflatable superstructure maintaining said net in an extended deployed configuration, said net including a plurality of rods held in a constant spaced relationship with respect to one another in space by the net and the inflatable superstructure for destroying the target in case the hit-to-kill vehicle misses the target.

2. The method of claim 1 in which the net is round and includes vertical members intersecting horizontal members.

3. The method of claim 1 in which the net is round and includes circular members intersecting radially extending members.

4. The method of claim 1 in which the net includes intersecting members and the rods are disposed at the intersection of the members.

* * * * *